US006066817A

United States Patent [19]

Flegel

[11] Patent Number: 6,066,817

[45] Date of Patent: May 23, 2000

[54] SOCKET-TYPE CIRCUIT BREAKER MOUNTING SYSTEM

[75] Inventor: David D. Flegel, Racine, Wis.

[73] Assignee: Reliance Controls Corporation, Racine, Wis.

[21] Appl. No.: 09/268,964

[22] Filed: Mar. 16, 1999

[51] Int. Cl.[7] ..... H01H 9/02

[52] U.S. Cl. ..... 200/296; 361/627; 439/621

[58] Field of Search ..... 361/627, 634, 361/636, 652, 653, 656, 673; 200/296, 297, 298; 439/338, 339, 621, 722, 557, 723, 550–551

[56] References Cited

U.S. PATENT DOCUMENTS

| | | | |
|---|---|---|---|
| 3,158,701 | 11/1964 | Nadeau . | |
| 3,198,898 | 8/1965 | Piteo, Jr. . | |
| 3,647,997 | 3/1972 | Nerem . | |
| 3,705,280 | 12/1972 | Harms . | |
| 3,778,633 | 12/1973 | DeVisser et al. . | |
| 4,270,031 | 5/1981 | Borona et al. . | |
| 4,307,925 | 12/1981 | Drew | 339/147 |
| 4,376,239 | 3/1983 | Long et al. | 200/159 B |
| 4,510,357 | 4/1985 | Winterbottom . | |
| 4,665,284 | 5/1987 | Guinan . | |
| 4,711,367 | 12/1987 | Serr et al. | 361/394 |
| 4,902,859 | 2/1990 | Witzmann et al. . | |
| 4,906,958 | 3/1990 | Adamson . | |
| 4,924,041 | 5/1990 | Yee . | |
| 4,977,482 | 12/1990 | Langdon et al. | 361/366 |
| 4,980,525 | 12/1990 | Kasisako . | |
| 5,008,499 | 4/1991 | Yee et al. . | |
| 5,109,142 | 4/1992 | VonKannewurff et al. . | |
| 5,122,624 | 6/1992 | Benda . | |
| 5,172,087 | 12/1992 | Castonguay et al. . | |
| 5,189,385 | 2/1993 | Gnahn . | |
| 5,268,543 | 12/1993 | Ramos . | |
| 5,270,503 | 12/1993 | Frye . | |
| 5,310,969 | 5/1994 | Turek et al. . | |
| 5,315,476 | 5/1994 | Hendrick | 361/652 |
| 5,322,980 | 6/1994 | Benda . | |
| 5,562,341 | 10/1996 | Strauss | 362/226 |
| 5,648,646 | 7/1997 | Flegel . | |

OTHER PUBLICATIONS

"POWERLINK" Brochure, PL101, Reliance Time Controls, Inc. 1820 Layard Ave., Racine, WI 53404–2199, undated.

"GENTRAN Manual Transfer Switches For Portable Generators" Brochure, GT1094C, Reliance Time Controls, Inc., 1820 Layard Ave., Racine, WI 53404, undated.

*Primary Examiner*—Lincoln Donovan
*Assistant Examiner*—Nhung Nguyen
*Attorney, Agent, or Firm*—Andrus, Sceales, Starke & Sawall

[57] ABSTRACT

A circuit breaker mounting arrangement for use in a device such as a transfer switch includes a mounting member adapted for securement to the transfer switch. The circuit breaker includes a head portion having a reset member, and a rearwardly extending body portion which terminates in a rear end wall from which a pair of contact prongs extend. A mounting member is provided for each circuit breaker, and includes an internal recess or cavity adapted to receive the circuit breaker body portion. The mounting member further includes an end wall which in part defines the recess, and a pair of engagement members are mounted to the end wall. The engagement members are configured to receive the circuit breaker prongs when the circuit breaker is inserted into the passage of the mounting member, for establishing an electrical connection between the circuit breaker prongs and the engagement members. Each engagement member includes an external connection area adapted to be wired into the circuitry of the transfer switch, and the circuit breakers can be removed from the mounting members and selectively replaced as required without the need to disassemble the transfer switch to remove the circuit breaker from the electrical circuitry.

38 Claims, 5 Drawing Sheets

SOCKET-TYPE CIRCUIT BREAKER MOUNTING SYSTEM

BACKGROUND AND SUMMARY OF THE INVENTION

This invention relates to mounting of circuit breakers, and more particularly to a removable circuit breaker mounting arrangement for mounting a circuit breaker to a panel, such as is employed in a transfer switching mechanism for supplying auxiliary electrical power to an electrical load center.

A transfer switching mechanism typically takes the form of a panel adapted for mounting adjacent an electrical load center associated with the electrical system of a building, which is typically supplied with primary electrical power from a utility. The transfer switching mechanism is adapted to supply auxiliary power to the load center from a standby power source in the event of a power outage from the utility. The transfer switching mechanism generally includes a series of circuits, each of which is wired to one of the circuits of the load center, along with a power input arrangement for receiving auxiliary power from the generator. The transfer switching mechanism further includes a circuit breaker associated with each circuit, to limit the amperage supplied to each circuit. Circuit breakers utilized in such transfer switching mechanisms are generally in the form of a body including a pair of rearwardly facing contact members, in combination with a head portion to which a reset member is mounted. An opening is formed in the panel where each circuit breaker is to be mounted, and the circuit breaker body is inserted through the opening such that the circuit breaker head engages the forward surface of the panel. A retainer member is engaged with the circuit breaker body and with the rearward surface of the panel, to sandwich the panel therebetween and to affix the circuit breaker to the panel. The circuit breaker contact members are wired into the circuitry of the transfer switching mechanism in a manner as is known.

While this circuit breaker mounting arrangement is satisfactory in fixing the circuit breakers in position on the panel for wiring into the circuitry of the transfer switching mechanism, it is somewhat disadvantageous in that the circuit breakers cannot be easily removed for replacement in the event of a malfunction or when it is desired to replace a circuit breaker with one having a different amperage limit. In order to accomplish such removal and replacement, it is necessary to remove the retainer member and disconnect the wiring by which the circuit breaker is connected in the circuitry of the transfer switching mechanism. The replacement circuit breaker is then mounted to the panel and wired into the transfer switching mechanism circuitry in the same manner as carried out during initial installation.

It is an object of the present invention to provide a circuit breaker mounting arrangement which enables relatively quick and easy installation and replacement of circuit breakers to a panel, such as for use in a transfer switching mechanism. It is a further object of the invention to provide such a circuit breaker mounting arrangement which is relatively simply in its construction and installation. A further object of the invention is to provide such a circuit breaker mounting arrangement which entails a relatively low cost of manufacture and installation. A still further object of the invention is to provide such a circuit breaker mounting arrangement which entails essentially the same wiring connections as in past installations in which the circuit breaker itself is wired into a circuit.

In accordance with one aspect of the invention, a mounting member is provided for a circuit breaker which includes a body defining a rearwardly facing engagement surface, a forwardly facing reset member, and one or more rearwardly facing contact members. The mounting member includes a forwardly facing engagement area for engaging the rearwardly facing contact surface of the circuit breaker, and one or more engagement members for frictionally and releasably engaging the contact members when the circuit breaker is moved in a forward-rearward direction to engage the rearwardly facing contact surface of the circuit breaker with the forwardly facing engagement area of the mounting member. The circuit breaker contact members are disengageable from the engagement members upon movement of the circuit breaker in a rearward-to-forward direction relative to the mounting member. Each engagement member includes a connection area for providing an electrical connection to the circuit breaker contact members through the engagement member. The rearwardly facing engagement surface of the circuit breaker is defined by a head portion of the circuit breaker body located toward a forward end of the circuit breaker. The rearwardly facing contact members are in the form of a pair of contact members which extend rearwardly from a rear wall of the circuit breaker body. The forwardly facing engagement area of the mounting member is preferably in the form of a shoulder located toward a forward end defined by the mounting member. The one or more engagement members are mounted to a transverse wall defined by the mounting member located rearwardly of the shoulder. In one form, the mounting member includes a side wall which extends between the shoulder and the transverse wall. The side wall and the transverse wall are configured to define a cavity or recess within which at least a portion of the circuit breaker body is received.

The side wall and transverse wall of the mounting member cooperate to define a socket-type mounting arrangement for the circuit breaker, in which the circuit breaker body is received within a recess defined by the side wall and transverse wall. The socket member is configured to provide access to the reset member when the circuit breaker body is received within the recess. Each engagement member preferably defines an internal portion configured to engage one of the circuit breaker contact members when the circuit breaker body is engaged within the recess, and an external contact portion located exteriorly of the recess for providing an external electrical connection. In this manner, the external contact portions of the engagement members can be wired into a circuit, and the circuit breaker is selectively engageable within the circuit by engaging the circuit breaker contact members with the engagement members.

The mounting member transverse wall is in the form of an end wall defining the inner end of the cavity or recess within which the circuit breaker body is received. The engagement members are mounted to the end wall, and the internal portion of each engagement member preferably includes a slotted area which opens into the socket member recess. The circuit breaker contact members are preferably in the form of a pair of prongs which extend rearwardly from the rear end wall of the circuit breaker body, and each prong is adapted to be received within one of the slotted areas upon application of a push-on force to the circuit breaker. The engagement members may be separate from each other, and each may be in the form of a slot-defining member for receiving one of the prongs, and an extension of each slot-defining member which extends through the socket member end wall and defines an external connection area located exteriorly of the socket member end wall.

Each socket member is adapted for mounting to a panel via an opening formed in the panel, through which the socket member extends. The socket member preferably includes a flange adapted to engage the panel adjacent the opening, and a retainer member is adapted to engage the socket member to retain the socket member in position relative to the panel. The flange is engageable with a first surface of the panel, and the retainer member is separate from the panel and the socket member and is engageable with the socket member and a second surface of the panel, opposite the first surface, to sandwich the panel between the retainer member and the socket member flange to mount the socket member to the panel.

The invention further contemplates a method of mounting a circuit breaker to a member such as a panel, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
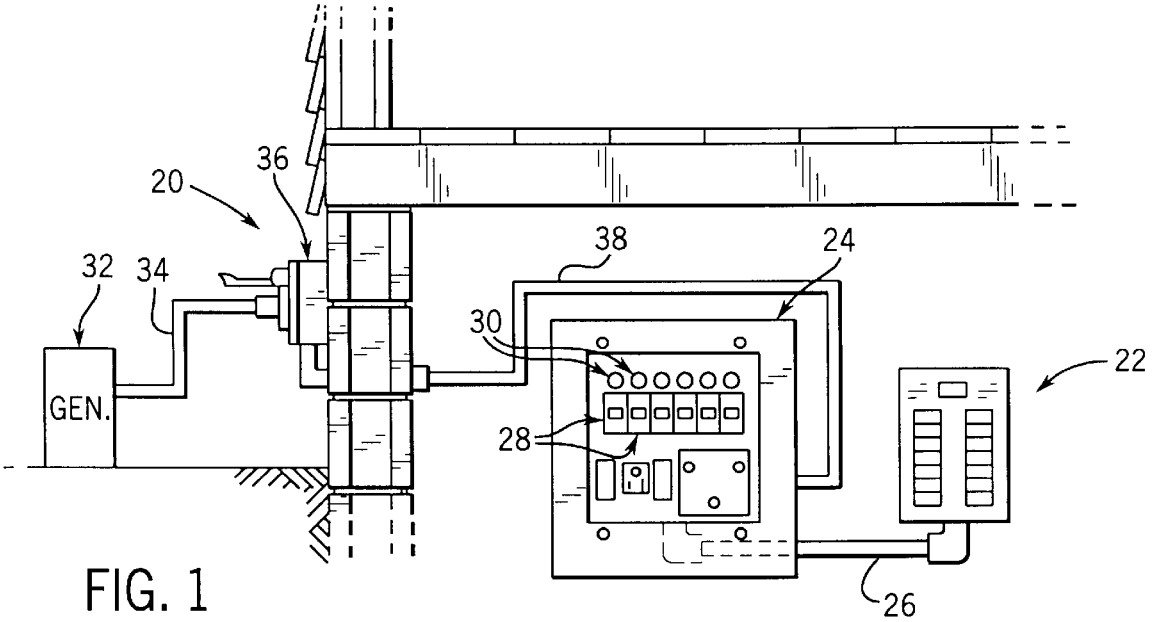
FIG. 1 is a partial elevation view showing a transfer switching mechanism for interconnecting a source of auxiliary electrical power with a load center.

FIG. 1 illustrates a building 20 incorporating an electrical load center 22 which is provided with primary electrical power, such as from a utility. Load center 22 is wired into a series of electrical circuits within building 20, and includes conventional circuit breakers for limiting the amperage load of each circuit, in a manner as is known. A transfer switch 24 is also mounted within building 20, and is adapted for interconnection with an auxiliary source of power, such as a generator 32, for supplying power to load center 22 in the event of a utility power outage.

Transfer switch 24 defines a series of circuits which are wired into selected circuits of load center 22 utilizing a series of wires housed within a conduit 26 extending between transfer switch 24 and load center 22. Each circuit of transfer switch 24 includes a switch 28 and a circuit breaker assembly, shown generally at 30.

Auxiliary power is supplied to transfer switch 24 from a generator 32 typically located exteriorly of building 20. A cord 34 extends from generator 32 and is adapted for removable connection to a power inlet box 36 mounted to the exterior of building 20. Power inlet box 36 is provided with an inlet for receiving the connector of cord 34 for receiving electrical power from generator 32, and provides input power to transfer switch 24 through a series of wires located within a conduit 38 which extends between power inlet box 36 and transfer switch 24.

Figure 3:
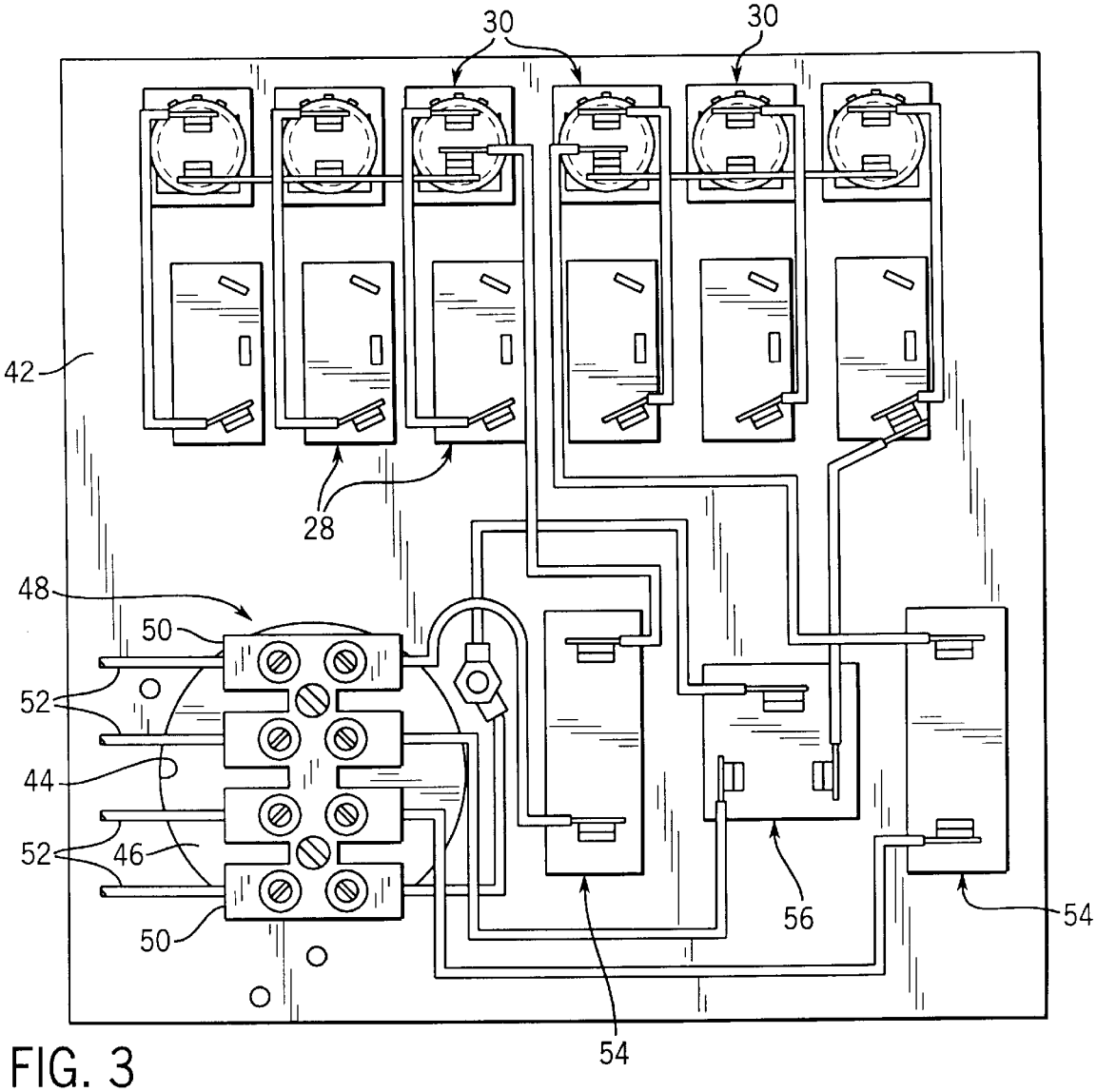
FIG. 3 is a rear elevation view of the front panel of the transfer switching mechanism of FIG. 2.

Transfer switch 24 includes a mounting plate 40 and a face plate 42. Referring to FIG. 3, face plate 42 defines an opening 44, and a terminal plate 46 is mounted to face plate 42 over opening 44. A terminal assembly 48 (FIG. 3) is mounted to the rear surface of terminal plate 46. Terminal assembly 48 defines a series of terminals 50, and power input, ground and neutral wires 52, which extend through conduit 38, are engaged with terminals 50 for providing input power, ground and neutral from power inlet box 36 to transfer switch 24.

Figure 2:
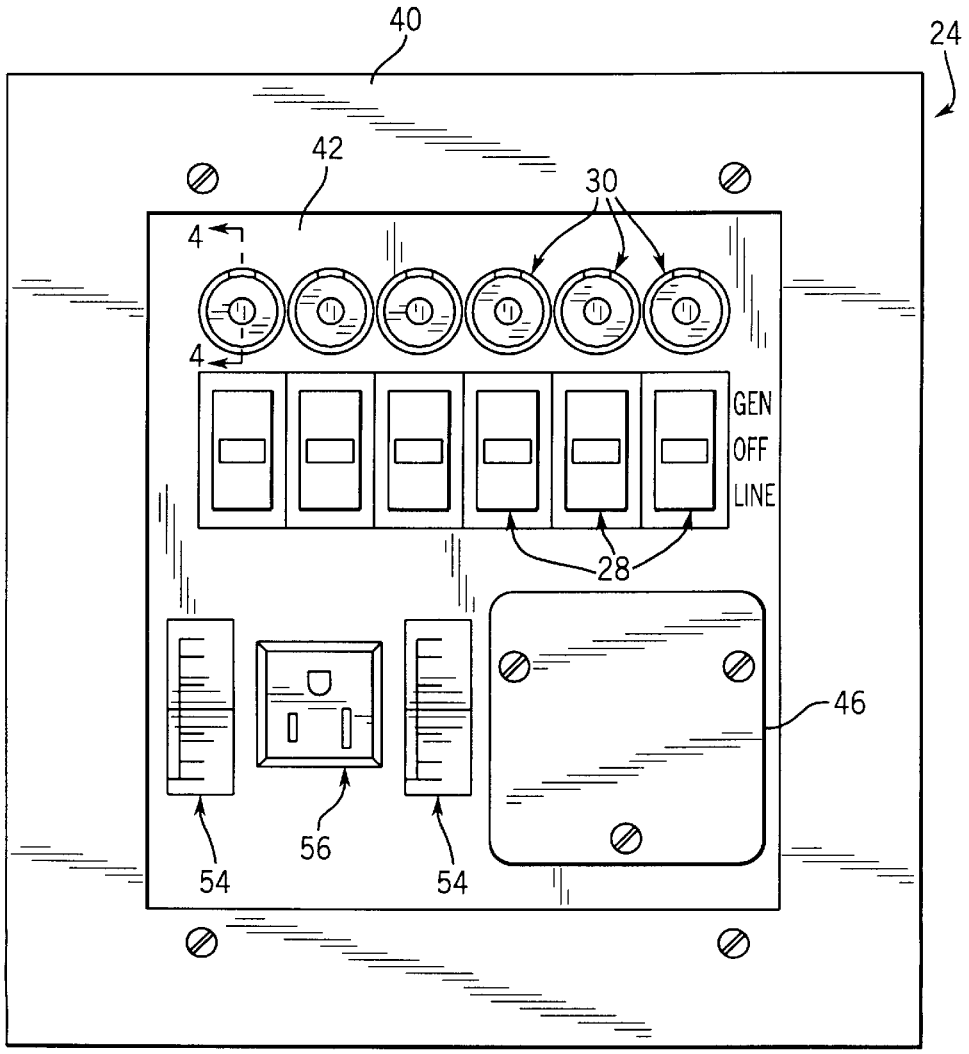
FIG. 2 is an elevation view of the front surface of the transfer switching mechanism of FIG. 1, showing circuit breakers mounted to the transfer switching mechanism utilizing the circuit breaker mounting system and method of the present invention.

Referring to FIGS. 2 and 3, internal wiring extends from terminal assembly 48 to a pair of watt meters 54 and an outlet receptacle 56 to switches 28 through circuit breaker assemblies 30. Conventional input and output wires (not shown) are interconnected with switches 28 and load center 22, and switches 28 are operable to control the supply of power from the circuits of transfer switch 24 to the circuits of load center 22, in a manner as is known. The internal wiring of transfer switch 24 is in accordance with conventional internal wiring of transfer panels of this type, which representatively may be such as is marketed by Reliance Controls Corporation of Racine, Wis. under its designation GENTRAN.

While the drawings illustrate terminal assembly 48 mounted to terminal plate 46 for engaging the input electrical wiring, it is understood that terminal assembly 48 may be mounted in any other location within the interior of transfer switch 24 such as is disclosed in pending U.S. patent application Ser. No. 09/021,670 filed Feb. 10, 1998, or alternatively input power may be provided to transfer switch 24 via a socket-type power inlet which receives a connector which may be wired into inlet box 36 for providing a selective supply of electrical power to transfer switch 24, again in a manner as is known.

Figure 4:
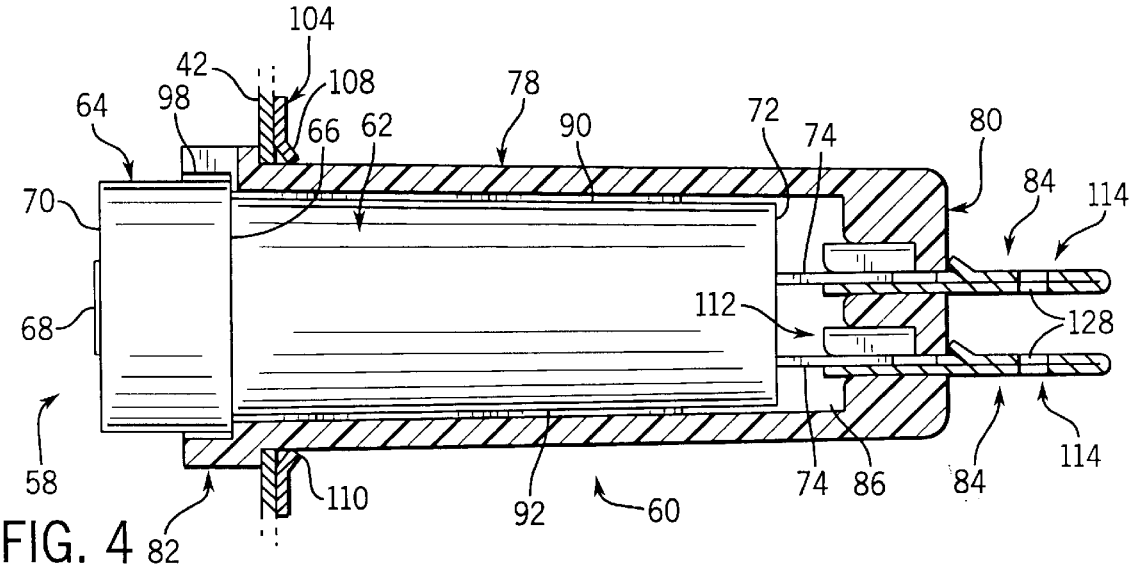
FIG. 4 is a partial section view taken along line 4—4 of FIG. 2.
Figure 5:
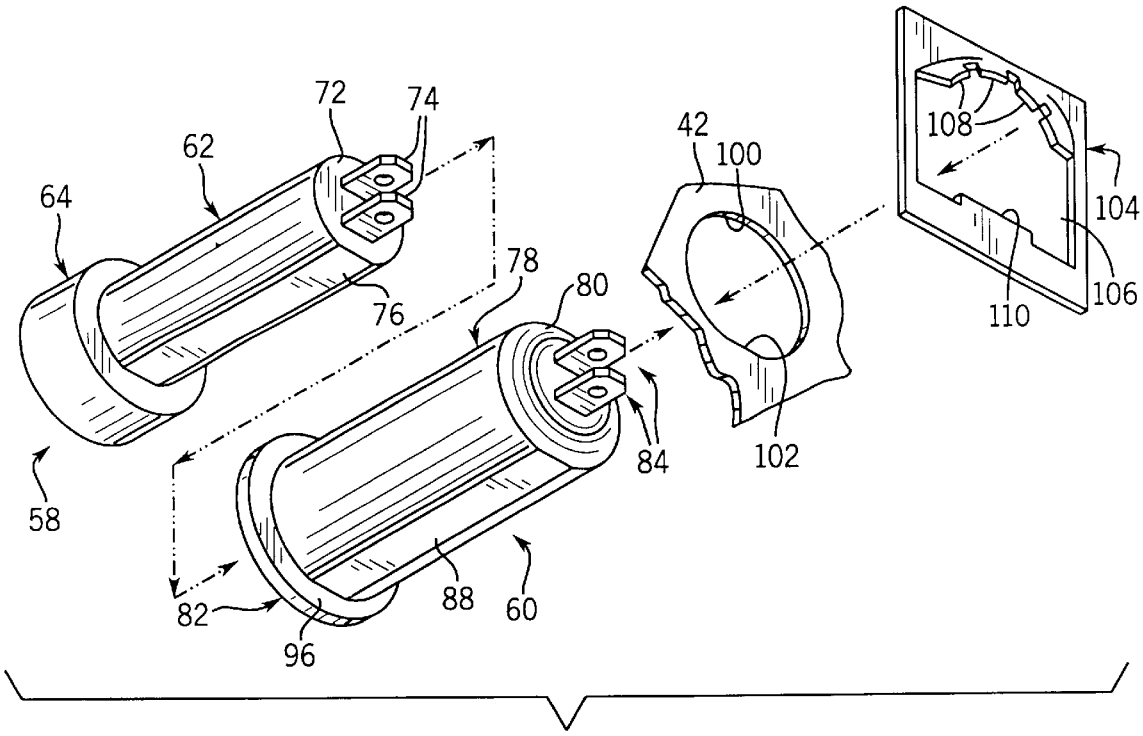
FIG. 5 is an exploded isometric view of the circuit breaker and mounting member of FIG. 4.

FIGS. 4 and 5 illustrate the construction of each circuit breaker assembly 30, which is mounted to face plate 42 of transfer switch 24. Generally, each circuit breaker assembly 30 includes a circuit breaker 58 and a socket-type circuit breaker mounting member 60 adapted for mounting to face plate 42.

Circuit breaker 58 includes a cylindrical body portion 62 and a head portion 64 located at the forward end of body portion 62. Head portion 64 defines a rearwardly facing engagement surface 66, which is located at the rearward end of head portion 64 and which defines the forward end of body portion 62. A manually engageable reset button 68 is mounted to the front surface of head portion 64, shown at 70. Body portion 62 defines a rearwardly facing rear wall 72, and a pair of contact members in the form of prongs 74 extend rearwardly from rear wall 72. This construction of circuit breaker 58 is in accordance with known technology, and a representative construction of circuit breaker 58 may be that such as is available from Eaton Heinemann Products of Salisbury, Md. under its designation RE-CIRK-IT, Part No. KD1, manufactured in accordance with U.S. Pat. No. 4,068,203. Circuit breaker body portion 62 includes a flat area 76 (FIG. 5) which extends throughout the length of body portion 62.

In accordance with the present invention, mounting member 60 is adapted for engagement with transfer switch face plate 42 for providing removable and replaceable mounting of circuit breaker 58 to transfer switch 24. Mounting member 60 is generally cylindrical in shape, and includes a side wall 78 which extends between a rear end wall 80 and a front flange 82. A pair of engagement members, shown generally at 84, are mounted to rear end wall 80 in a manner to be explained.

Side wall 78 and end wall 80 cooperate to define an internal cavity or recess 86 which opens in a forward direction and is accessible through an opening formed at the forward end of side wall 78 and flange 82. Recess 86 is adapted to receive circuit breaker body portion 62, in a manner to be explained.

Figure 6:
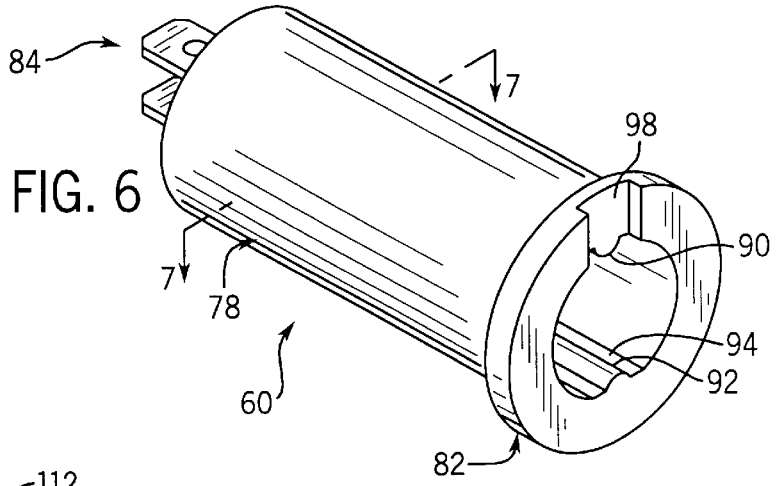
FIG. 6 is an isometric view of the circuit breaker mounting member illustrated in FIGS. 4 and 5.
Figure 7:
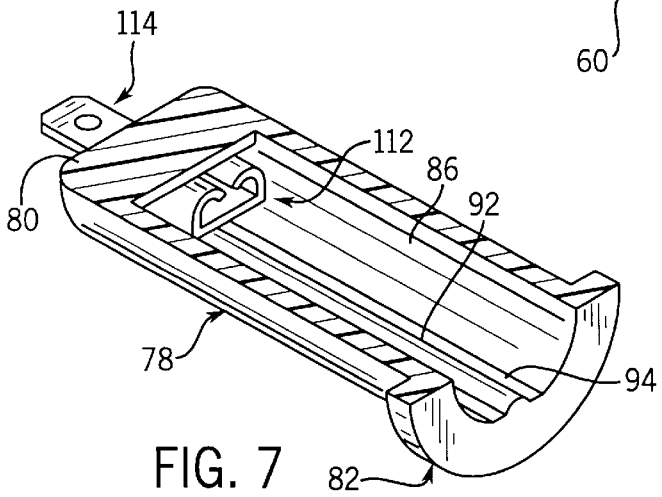
FIG. 7 is a section view taken along line 7—7 of FIG. 6.

Referring to FIG. 5, side wall 78 defines an external flat area 88 which extends throughout the length of mounting member 60 rearwardly of flange 82. The internal surface of side wall 78 is formed with a top rib 90 and a bottom rib 92 (FIG. 6), which extend rearwardly from the open forward end of recess 86 and which terminate at a location spaced forwardly from rear wall 80. The internal surface of side wall 78 is further formed to define a flat area 94 from which bottom rib 92 extends, and which extends throughout the length of recess 86.

Flange 82 defines a rearwardly facing shoulder 96 which extends laterally outwardly from the outer surface of side wall 78. A vertical, forwardly facing slot 98 is formed in the forward top region of flange 82, extending between the outer peripheral edge of flange 82 and recess 86.

Each mounting member 60 is adapted for engagement with transfer switch face plate 42 through an opening 100 formed in face plate 42. Each opening 100 includes a flat edge 102 at its lower extent, and mounting member 60 is inserted through opening 100 such that the flat area 88 of side wall 78 is located at flat edge 102 of opening 100. In this manner, opening 100 and mounting member side wall 78 define a mating non-circular configuration, to provide a predetermined orientation of mounting member 60 relative to face plate 42. Mounting member 60 is fully inserted through opening 100 in face plate 42 until shoulder 96 of flange 82 engages the front surface of face plate 42, as shown in FIG. 4. A retainer member, shown generally at 104, is then engaged with the portion of mounting member 60 located rearwardly of face plate 42. Retainer member 104 includes an opening 106 and a series of downwardly and rearwardly extending teeth 108 at the upper edge of opening 106. An upwardly and rearwardly extending tooth 110 is located at the lower extent of opening 106.

After mounting member 60 is fully inserted through face plate opening 100 as shown in FIG. 4, retainer member 104 is engaged with mounting member side wall 78 using a rearward-to-forward push-on motion until retainer member 104 is engaged with the rear surface of face plate 42, also as shown in FIG. 4. Mounting member side wall 78 is slightly tapered in a forward-to-rearward direction, and engagement of retainer member 104 with retainer member side wall 78 thus functions to deflect upper teeth 108 and lower tooth 110 rearwardly as retainer member 104 is pushed forwardly on mounting member side wall 78. Mounting member 60 may be made of a plastic or other resinous material, and retainer member 104 is preferably made of a metallic material such that teeth 108, 110 are deflected rearwardly and dig into the surfaces of side wall 78 as retainer member 104 is pushed forwardly into engagement with the rear surface of face plate 42. In this manner, face plate 42 is clamped or sandwiched between retainer member 104 and shoulder 96 defined by flange 82, to securely engage mounting member 60 with face plate 42.

Referring to FIGS. 4 and 7–10, each engagement member 84 includes an internal contact portion 112 and an external connection area 114. Contact portion 112 is mounted to mounting member end wall 80 and connection area 114 extends rearwardly from the rear surface of end wall 80.

Figure 9:
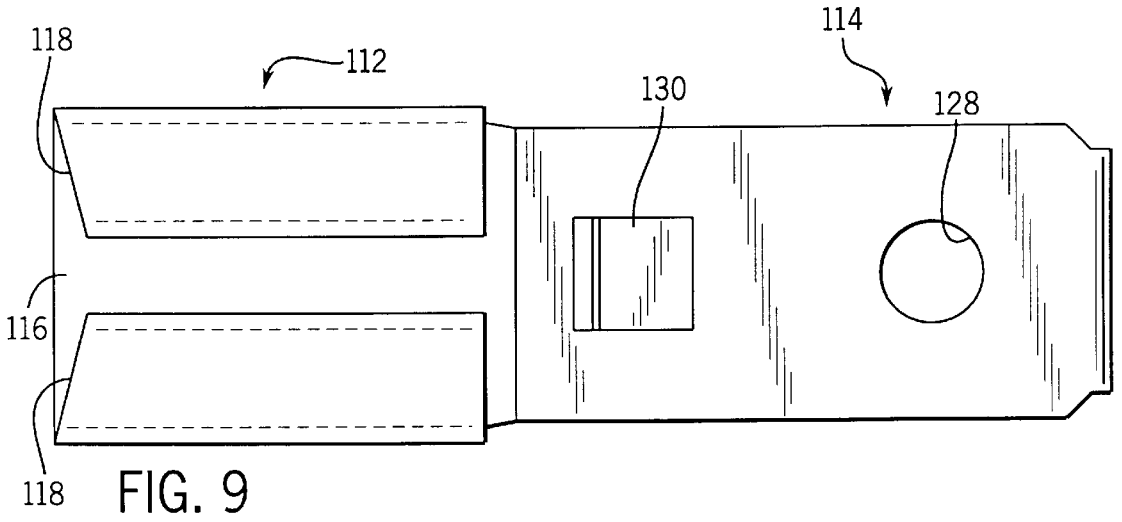
FIG. 9 is an enlarged elevation view of an electrically conductive engagement member forming a part of the circuit breaker mounting member of FIGS. 6 and 7.
Figure 10:
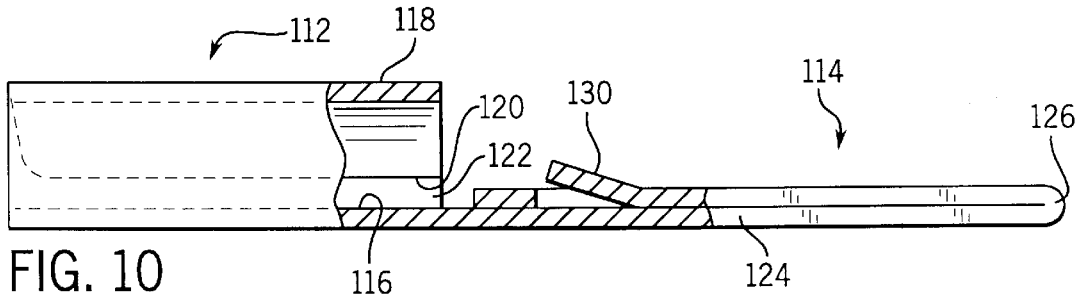
FIG. 10 is a side elevation view, with portions broken away, of the electrically conductive engagement member of FIG. 9.

Referring to FIGS. 9 and 10, contact portion 112 of each engagement member 84 includes an engagement wall 116 having extended wings 118 which are formed so as to extend outwardly away from engagement wall 116 from the side edges of engagement wall 116, and to then curl inwardly toward each other and terminate in inner biasing end sections 120 located adjacent each other. End sections 120 are spaced slightly above the facing surface of engagement wall 116, to define a slot 122 therebetween. Each slot 122 is adapted to receive one of prongs 74 of circuit breaker 58, for establishing an electrical contact therewith.

Connection area 114 of each engagement member 84 is defined by a rearward extension of engagement wall 116 which is bent back onto itself to form a dual-layer construction for connection area 114. The extended area of engagement wall 116 is shown at 124, and is bent at rear end 126 onto itself to define connection area 114. A connection opening 128 (FIG. 9) is formed in connection area 114. A tab 130 is cut out of the material of extended area 124 adjacent its inner end, and is laterally deflected outwardly in the same direction as wings 118.

Figure 8:
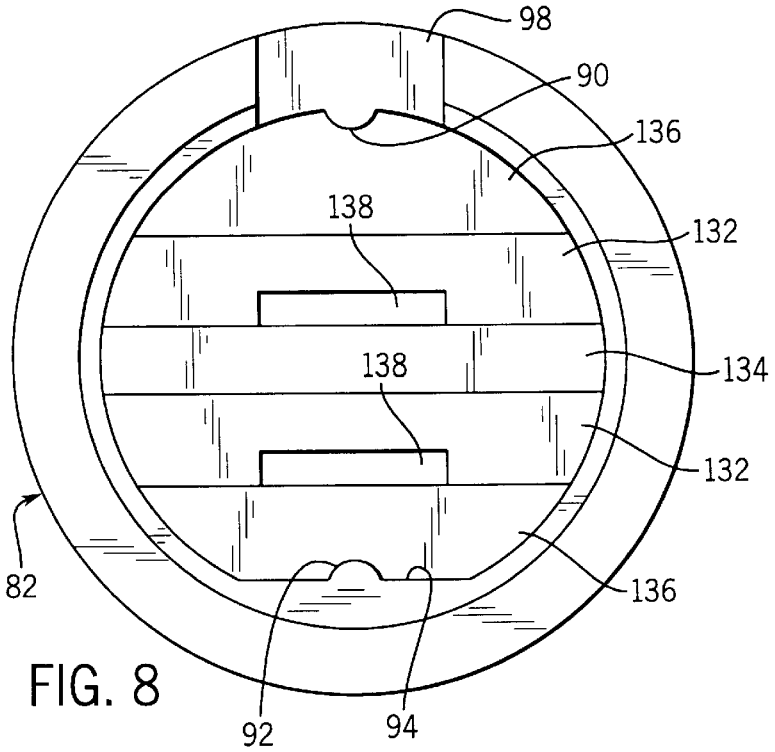
FIG. 8 is an end elevation view of the circuit breaker mounting member of FIGS. 6 and 7.

Referring to FIGS. 4 and 8, mounting member end wall 80 defines a pair of transversely extending troughs 132 separated by a central ridge 134. An outer land 136 is located outwardly of each trough 132. Troughs 132 have a depth less than the thickness of end wall 80, and a rectangular slot 138 extends between the bottom of each trough 132 and the rear surface of end wall 80.

Each engagement member 84 is mounted to end wall 80 utilizing a push-on motion in which each engagement member 84 is inserted through recess 86 toward end wall 80. Each contact member connection area 114 is inserted through one of slots 138, to enable movement of contact portion 112 into trough 132. As rearward movement of engagement member 84 continues to move contact portion 112 into trough 132, tab 130 passes through slot 138 and is deflected toward a position coplanar with the material of extended area 124 from which tab 130 is formed. When contact portion 112 is moved fully into trough 132 so as to engage the end of trough 132 as shown in FIG. 4, tab 130 is in a position in which its end clears the rear surface of end wall 80 to return to its deflected condition to engage the rear surface of end wall 80 adjacent the area at which slot 138 opens onto the rear surface of end wall 80. This movement of tab 130 functions to prevent subsequent movement of engagement member 84 in a forward direction, and engagement of the end of contact portion 112 with the end of trough 132 prevents further rearward movement of engagement member 84. In this manner, engagement member 84 is securely mounted to mounting member end wall 80.

Connection areas 114 of engagement members 84 are utilized to connect the internal wiring of transfer switch 24, in the same manner as circuit breaker prongs 74 had been utilized in the prior art to provide a connection into the circuitry of transfer switch 24. Accordingly, once mounting member 60 is engaged with face plate 42 as described above and engagement members 84 are wired into the circuitry of transfer switch 24, mounting members 60 are adapted to receive a circuit breaker 58 for completing the electrical circuitry of transfer switch 24.

In operation, each mounting member 60 is adapted to mount one of circuit breakers 58 as follows. Circuit breaker 58 is first aligned with mounting member 60 such that flat area 76 of circuit breaker body portion 62 is in alignment with flat area 94 in mounting member recess 86. Circuit breaker body portion 62 is then inserted into recess 86 using a push-on forward-to-rearward motion. Top rib 90 engages the upper area of body portion 62 and bottom rib 92 engages flat area 76, to provide a frictional engagement of circuit breaker body portion 62 with mounting member 60. The user continues application of a push-on force to move circuit breaker body portion 62 rearwardly within recess 86, which results in the rearward end of each prong 74 moving into slot 122 defined by contact portion 112 of one of engagement members 84. Slot 122 is configured so as to be slightly narrower than the width of each prong 74, such that movement of prong 74 into slot 122 deflects end sections 120 slightly upwardly to provide a frictional engagement of prong 74 with end section 120 and engagement wall 116. This establishes an electrical connection between each contact portion 112 and one of prongs 74. The user continues such rearward movement of circuit breaker 58 until engagement surface 66 defined by the rear edge of circuit breaker head portion 64 engages the front surface of flange 82, as shown in FIG. 4. In this manner, with engagement members 84 wired into the circuitry of transfer switch 24, circuit breaker 58 is engaged with the transfer switch circuitry through the electrical connections of prongs 74 to engagement members 84.

When it is necessary to remove circuit breaker 58 for replacement with another circuit breaker of the same or different amperage limit, circuit breaker 58 is removed from mounting member 60 by inserting the tip of a tool, such as a screwdriver, into transverse slot 98 in flange 82 such that the tip is located behind engagement surface 66. The user then utilizes the tool to exert a rearward-to-forward pull-out force on circuit breaker 58 to initially move circuit breaker 58 outwardly and to disengage prongs 74 from engagement members 84. The user then manually withdraws circuit breaker 58 from recess 86, and a replacement circuit breaker is mounted in the same manner as described previously for connection into the circuitry of transfer switch 24.

It can thus be appreciated that mounting member 60 provides quick and easy replacement of circuit breakers once transfer switch 24 is installed. In addition, mounting members 60 enable the manufacturer to provide different circuits of transfer switch 24 with different amperage capacities as desired, either according to different transfer switch models or according to user requirements. Further, use of mounting members 60 enables an installer to customize transfer switch 24 at the time of installation, according to the capacity of the load center circuits which are interconnected with the circuits of transfer switch 24.

Figure 11:
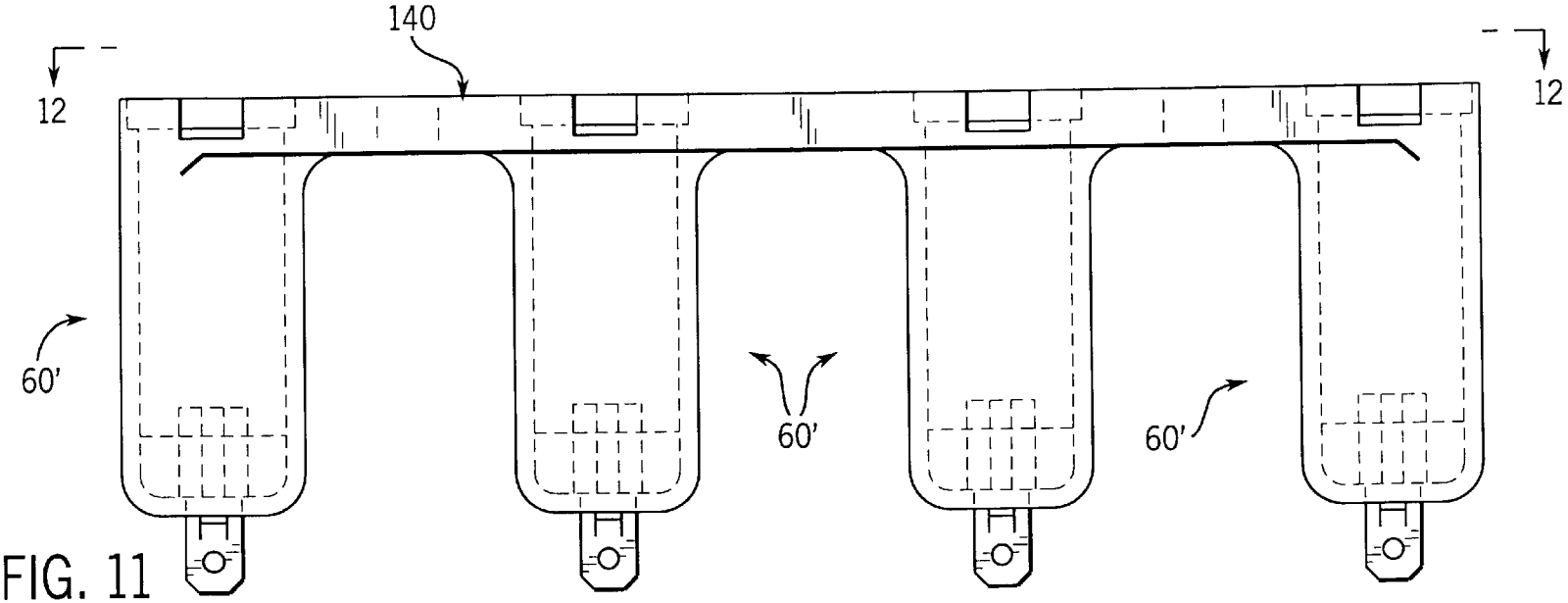
FIG. 11 is a top plan view of an alternative embodiment of the circuit breaker mounting arrangement of the invention, showing a ganged circuit breaker mounting configuration.
Figure 12:
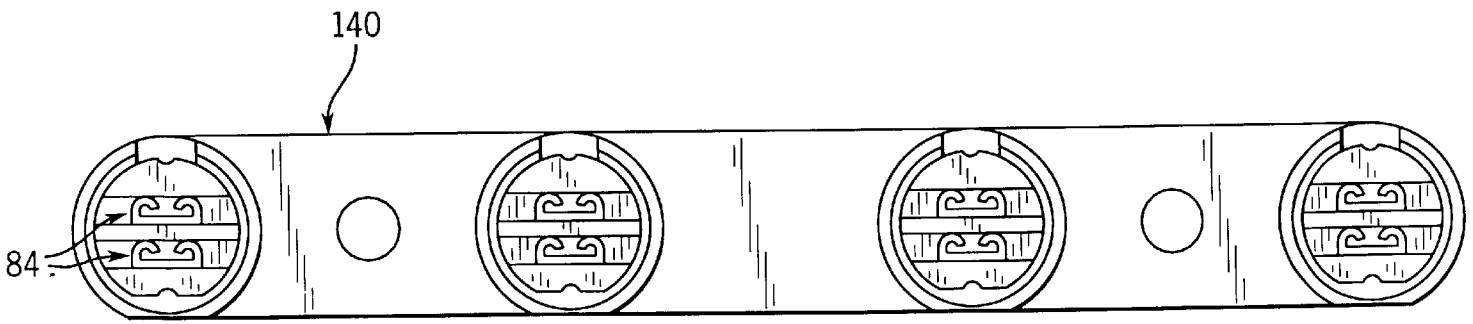
FIG. 12 is a front elevation view of the ganged circuit breaker mounting member of FIG. 11, with reference to line 12—12 of FIG. 11.

FIG. 11 illustrates an alternative embodiment in which a series of socket members, shown generally at 60', are interconnected with a panel mounting member 140. Each mounting member 60' has a construction like that of mounting member 60 described previously, and panel mounting member 140 is formed integrally with the flange of each mounting member 60' for providing a ganged construction of circuit breaker mounting members for connection to a transfer switch face plate. This type of panel mounting construction is particularly well suited for high volume applications, and reduces the overall time and assembly involved in engaging the circuit breaker mounting members with the transfer switch face plate.

Various alternatives and embodiments are contemplated as being within the scope of the following claims particularly pointing out and distinctly claiming the subject matter regarded as the invention.

I claim:

1. A mounting arrangement for a circuit breaker having a body, a reset member, and one or more prong-type contact members interconnected with and extending from the body, comprising:

a socket member defining a recess adapted to receive at least a portion of the circuit breaker body and the contact members, wherein the socket member is configured to provide access to the reset member when the circuit breaker body is received within the recess; and one or more electrically conductive prong-type engagement members associated with the socket member, wherein each engagement member defines an internal slotted portion configured to engage one of the prong-type contact members when the circuit breaker body is engaged within the recess, and an external prong-type contact portion extending from the internal slotted portion for providing an electrical connection externally of the recess.

2. The transfer switch mechanism of claim 1, wherein the socket member is mounted to the wall structure at an opening formed in the wall structure, and wherein the socket member includes at least one side wall and an end wall which cooperate to define the recess, wherein the internal portion of each engagement member is mounted to the end wall.

3. The transfer switch mechanism of claim 2, wherein the internal portion of each engagement member includes a slotted area, wherein each circuit breaker contact member extends from the circuit breaker body and is received within the slotted area of one of the engagement members upon application of a push-on force to the circuit breaker for inserting the circuit breaker into the recess.

4. The transfer switch mechanism of claim 3, wherein the one or more electrically conductive engagement members comprise a pair of separate engagement members adapted for mounting to the socket member end wall.

5. The transfer switch mechanism of claim 4, wherein the socket member end wall includes a pair of passages, each of which is adapted to receive one of the engagement members.

6. The transfer switch mechanism of claim 2, wherein the socket member includes a flange adapted to engage the wall structure adjacent the opening, and further comprising a retainer member configured to engage the socket member to retain the socket member in position relative to the panel when the flange is engaged with the panel adjacent the opening.

7. The transfer switch mechanism of claim 6, wherein the socket member flange engages an outer surface of the wall structure, and wherein the retainer member is separate from the wall structure and the socket member and is located in the interior of the housing, wherein the retainer member is engageable with the socket member and an inner surface of the wall structure opposite the outer surface such that the wall structure is sandwiched between the retainer member and the socket member flange to mount the socket member to the wall structure.

8. The transfer switch mechanism of claim 2, wherein the socket member defines a shoulder at an entrance to the recess, wherein the circuit breaker body includes a head portion adapted for engagement with the socket member shoulder upon application of a push-on force to the circuit breaker for inserting the circuit breaker body into the recess.

9. The transfer switch mechanism of claim 8, wherein the shoulder is spaced relative to the engagement members such that application of a push-on force to the circuit breaker for engaging the circuit breaker head portion with the socket member shoulder functions to engage the circuit breaker contact members with the internal portion of the engagement members mounted to the socket member end wall.

10. A system for mounting a circuit breaker to a member having an opening, wherein the circuit breaker includes a body, one or more contact members mounted to the body, and a reset member, comprising a socket adapted to extend through the opening for mounting to the member and defining a recess for receiving at least a portion of the circuit breaker body, wherein the socket is configured to provide access to the reset member when the socket is mounted to the member, and wherein the socket further includes electrically conductive engagement structure within the recess positioned to engage the one or more contact members, and an external connection area located exteriorly of the recess for providing an electrical connection to the circuit breaker contact members through the engagement structure, wherein the opening in the member defines a non-circular shape and wherein the socket defines a mating non-circular shape, wherein the socket is adapted for insertion through the opening and wherein the non-circular shape of the opening and the mating non-circular shape of the socket are operable to provide a predetermined orientation of the socket relative to the member.

11. The circuit breaker mounting system of claim 10, wherein the socket comprises an end wall and at least one side wall which cooperate to define the recess, and wherein the socket is adapted for mounting to the member by means of engagement structure associated with the side wall.

12. The circuit breaker mounting system of claim 10, wherein the opening in the member defines at least one linear edge, and wherein the socket includes a flat external surface adapted to engage the linear edge of the opening to orient the socket relative to the member upon insertion of the socket through the opening.

13. The circuit breaker mounting system of claim 12, wherein the opening is generally arcuate and circular other than at the linear edge, and wherein an external surface of the socket is generally arcuate and circular other than at the flat external surface and matingly engageable within the opening.

14. A system for mounting a circuit breaker to a member having an opening, wherein the circuit breaker includes a body, one or more contact members mounted to the body, and a reset member, comprising a socket adapted for mounting to the member and including an end wall and at least one side wall which cooperate to define a recess for receiving at least a portion of the circuit breaker body, wherein the socket is configured to provide access to the reset member when the socket is mounted to the member, and wherein the socket further includes electrically conductive engagement structure within the recess positioned to engage the one or more contact members, and an external connection area located exteriorly of the recess for providing an electrical connection to the circuit breaker contact members through the engagement structure, wherein the socket includes a flange engageable with a first surface of the member adjacent the opening, and further comprising a retainer member engageable with the socket side wall and with a second surface of the member opposite the first surface.

15. The circuit breaker mounting system of claim 14, wherein the socket side wall is tapered, and wherein the retainer member includes an opening within which the socket is received, wherein push-on engagement of the retainer member with the socket engages the socket side wall with an edge of the opening.

16. The circuit breaker mounting system of claim 15, wherein the retainer member includes opposed deflectable teeth at the edge of the opening, wherein push-on engagement of the retainer member with the socket engages the teeth with the socket side wall and deflects the teeth to secure the retainer member to the socket.

17. A system for mounting a plurality of circuit breakers to a member, wherein each circuit breaker includes a body, one or more contact members mounted to the body, and a reset member, comprising a plurality of sockets adapted for mounting to the member, wherein each socket defines a recess for receiving the body of one of the circuit breakers, wherein each socket in the plurality of sockets is interconnected with a forward mounting section, wherein each socket is configured to provide access to the reset member when the sockets are mounted to the member, and wherein each socket further includes electrically conductive engagement structure within the recess positioned to engage the one or more contact members of one of the circuit breakers, and an external connection area located exteriorly of the recess for providing an electrical connection to the circuit breaker contact members through the electrically conductive engagement members.

18. The circuit breaker mounting system of claim 17, wherein the member includes a plurality of openings and wherein each socket is adapted to extend through one of the openings, wherein the forward mounting section is engageable with a front surface of the member and wherein the sockets extend rearwardly from a rear surface of the member opposite the front surface.

19. The circuit breaker mounting system of claim 17, wherein the forward mounting section is integrally formed with the plurality of sockets.

20. A system for mounting a circuit breaker to a member, wherein the circuit breaker includes a body, one or more contact members mounted to the body, and a reset member, comprising a socket adapted for mounting to the member and defining a recess for receiving the circuit breaker body, wherein the socket is configured to provide access to the reset member when the socket is mounted to the member, and wherein the socket further includes electrically conductive engagement structure within the recess positioned to engage the one or more contact members, and an external connection area located exteriorly of the recess for providing an electrical connection to the circuit breaker contact members through the engagement structure;

wherein the circuit breaker contact members comprise a pair of prongs which extend rearwardly from a rear wall of the circuit breaker body, and wherein the electrically conductive engagement structure within the recess comprises a pair of slot-defining members, each of which is adapted to engage one of the pair of prongs, and wherein the external connection area comprises an extension of each slot-defining member which extends through a wall of the socket exteriorly of the recess.

21. The circuit breaker mounting system of claim 20, wherein the socket comprises an end wall and a side wall which cooperate to define the recess, wherein the slot-defining members are mounted to the end wall and wherein the extension of each slot-defining member extends through the end wall.

22. The circuit breaker mounting system of claim 21, wherein the socket end wall defines a pair of passages, and wherein one of the slot-defining members is received within each of the passages.

23. The circuit breaker mounting system of claim 22, wherein each slot-defining member includes a deflectable tab, wherein the slot-defining member is adapted for insertion through one of the passages, wherein the deflectable tab passes through the passage and thereafter deflects into engagement with the end wall adjacent the passage for securing the slot-defining member to the end wall.

24. The circuit breaker mounting system of claim 23, wherein each slot-defining member further includes an inner portion received within a trough formed in the socket end wall from which one of the passages extends.

25. The circuit breaker mounting system of claim 24, wherein the inner portion of each slot-defining member comprises a contact portion which in part defines a slot adapted to receive one of the pair of prongs.

26. The circuit breaker mounting system of claim 25, wherein the contact portion of each slot-defining member defines an end area adapted to engage an end surface defined by the trough, so as to cooperate with the tab to maintain the slot-defining member in engagement with the socket end wall.

27. A mounting member for mounting a circuit breaker, wherein the circuit breaker includes a body defining a rearwardly facing engagement surface, a forwardly facing reset member, and one or more rearwardly facing contact members, comprising a forward area; a recess extending rearwardly from the forward area adapted to receive at least a portion of the circuit breaker body, and one or more engagement members for frictionally and releasably engaging the contact members when the circuit breaker is moved in a forward-rearward direction, wherein the contact members are disengageable from the engagement members upon movement in a rearward-to-forward direction, and wherein each engagement member includes a connection area for providing an electrical connection to the circuit breaker contact members through the engagement members, wherein the forward area includes a slot located so as to provide access to the rearwardly facing engagement surface with a tool to apply a rearward-forward force to the circuit breaker.

28. The circuit breaker mounting member of claim 27, wherein the forward area of the mounting member includes a transverse surface adapted to engage the rearwardly facing engagement surface of the circuit breaker body, and wherein the slot is formed in the transverse surface.

29. The circuit breaker mounting member of claim 28, wherein the rearwardly facing engagement surface engages the transverse surface and is defined by a head portion of the circuit breaker body located toward a forward end of the circuit breaker, and wherein the rearwardly facing contact members comprise a pair of contact members extending rearwardly from a rear wall of the circuit breaker body, and wherein the transverse surface comprises a shoulder located toward a forward end defined by the mounting member, and wherein the one or more engagement members are mounted to a transverse wall defined by the mounting member located rearwardly of the shoulder.

30. The circuit breaker mounting member of claim 29, further comprising a side wall extending between the shoulder and the transverse wall, wherein the side wall and the transverse wall cooperate to define the recess within which at least a portion of the circuit breaker body is received.

31. A method of mounting a circuit breaker to a transfer switch mechanism, wherein the circuit breaker includes a body, a reset member, and one or more contact members interconnected with the body, comprising the steps of:

mounting a receiver to a panel forming a part of a housing of the transfer switch mechanism, wherein the receiver includes a recess, an internal wall forming at least a part of the recess, and one or more electrically conductive engagement members having an internal engagement area accessible from the recess and an external contact area located externally of the recess; and engaging a circuit breaker with the receiver utilizing a push-on motion for moving the circuit breaker into the recess such that at least a portion of the circuit breaker body is received within the recess and such that the circuit breaker contact members engage the engagement members, wherein the circuit breaker reset member is accessible from the exterior of the panel when the circuit breaker is engaged with the receiver.

32. The method of claim 31, wherein the receiver includes a forwardly facing shoulder and the circuit breaker includes a rearwardly facing engagement surface, and wherein the step of engaging the circuit breaker with the receiver is carried out such that the rearwardly facing engagement surface of the circuit breaker is engaged with the forwardly facing shoulder of the receiver.

33. The method of claim 32, wherein the one or more electrically conductive engagement members of the receiver are mounted to an end wall defined by the receiver and forming at least a part of the recess, and wherein the step of engaging the circuit breaker with the receiver is carried out such that the circuit breaker contact members are engaged with the engagement members when the rearwardly facing engagement surface of the circuit breaker is engaged with the forwardly facing shoulder of the receiver.

34. The method of claim 33, wherein the one or more contact members of the circuit breaker extend rearwardly from a rear end wall defined by the circuit breaker, and wherein the end wall of the receiver is oriented relative to the forwardly facing shoulder of the receiver such that push-on engagement of the circuit breaker with the receiver to engage the rearwardly facing shoulder of the circuit breaker with the forwardly facing engagement surface of the receiver positions the rear wall of the circuit breaker in forwardly spaced relationship relative to the end wall of the receiver and the contact members of the circuit breaker extend rearwardly therefrom into engagement with the engagement members of the receiver.

35. A transfer switch mechanism, comprising:

a housing including wall structure defining an interior;

a power inlet arrangement associated with the housing;

at least one switch member interconnected with the power inlet arrangement; and a circuit breaker mounting arrangement interconnected with the power inlet arrangement and the switch member for mounting a circuit breaker having a body, a reset member, and contact structure interconnected with the body, wherein the circuit breaker mounting arrangement comprises a socket member mounted to the wall structure and defining a recess adapted to receive at least a portion of the circuit breaker body, wherein the socket member is configured to provide access to the reset member when the circuit breaker body is received within the recess; and one or more electrically conductive engagement members associated with the socket member, wherein each engagement member defines an internal portion configured to engage one of the contact members when the circuit breaker body is engaged within the recess, and an external contact portion located within the interior of the housing for providing an electrical connection externally of the recess.

36. A mounting member for mounting a circuit breaker, wherein the circuit breaker includes a body defining a rearwardly facing surface, a forwardly facing reset member, and one or more rearwardly facing contact members, wherein at least a portion of the body defines a non-circular external surface, comprising a forward area, a recess extending rearwardly from the forward area adapted to receive at least a portion of the circuit breaker body, and one or more engagement members for frictionally and releasably engaging the contact members when the circuit breaker is moved in a forward-rearward direction, wherein the contact members are disengageable from the engagement members upon movement in a rearward-to-forward direction, and wherein each engagement member includes a connection area for providing an electrical connection to the circuit breaker contact members through the engagement members, wherein the recess includes orienting structure which cooperates with the non-circular external surface of the body for orienting the circuit breaker in a predetermined orientation relative to the mounting member for aligning the contact members with the engagement members.

37. The mounting member of claim 36, wherein the recess is defined by a side wall and wherein the orienting structure comprises a rib formed in the side wall and extending into the recess, wherein the rib is engageable with a flat surface forming the non-circular external surface of the body to orient the circuit breaker relative to the mounting member.

38. In a transfer switch mechanism including a housing having wall structure defining an interior, a power inlet arrangement associated with the housing, and at least one switch member interconnected with the power inlet arrangement, the improvement comprising a circuit breaker mounting arrangement interconnected with the power inlet arrangement and with the switch member for mounting a circuit breaker having a body, a reset member, and contact structure interconnected with the body, wherein the circuit breaker mounting arrangement comprises a socket member mounted to the wall structure and defining a recess adapted to receive at least a portion of the circuit breaker body, wherein the socket member is configured to provide access to the reset member when the circuit breaker body is received within the recess; and one or more electrically conductive engagement members associated with the socket member, wherein each engagement member defines an internal portion configured to engage one of the contact members when the circuit breaker body is engaged within the recess, and an external contact portion located within the interior of the housing for providing an electrical connection externally of the recess.

* * * * *

UNITED STATES PATENT AND TRADEMARK OFFICE

CERTIFICATE OF CORRECTION

PATENT NO. : 6,066,817

DATED : May 23, 2000

INVENTOR(S) : DAVID D. FLEGEL

It is certified that error appears in the above-identified patent and that said Letters Patent is hereby corrected as shown below:

IN THE CLAIMS

Claim 2, column 8, line 38, delete "1" and substitute therefor -- 35 --.

Signed and Sealed this

Twenty-fourth Day of April, 2001

*Attest:*

*Attesting Officer*

Nicholas P. Godici

NICHOLAS P. GODICI

*Acting Director of the United States Patent and Trademark Office*